US006808087B1

(12) United States Patent
Ford

(10) Patent No.: US 6,808,087 B1
(45) Date of Patent: Oct. 26, 2004

(54) FUEL DISPENSING SYSTEM HAVING A SELECTABLE PUMP CONTROLLER

(75) Inventor: James A. Ford, Greensboro, NC (US)

(73) Assignee: Power Integrity Corp., Greensboro, NC (US)

( * ) Notice: Subject to any disclaimer, the term of this patent is extended or adjusted under 35 U.S.C. 154(b) by 66 days.

(21) Appl. No.: 10/083,223

(22) Filed: Feb. 26, 2002

(51) Int. Cl.[7] ..... B67D 5/06
(52) U.S. Cl. ..... 222/144.5; 222/25; 222/52
(58) Field of Search ..... 222/71, 25, 63, 222/135, 132, 52, 144.5, 266, 26–28; 700/231–232, 282–283; 361/189, 191

(56) References Cited

U.S. PATENT DOCUMENTS 2,935,025 A * 5/1960 Wright et al. ..... 417/422
3,696,364 A 10/1972 Lavelle ..... 340/252
4,247,899 A * 1/1981 Schiller et al. ..... 705/413
4,719,532 A 1/1988 Schneider ..... 361/189
5,602,745 A * 2/1997 Atchley et al. ..... 705/413
5,831,861 A * 11/1998 Warn et al. ..... 700/231
5,874,787 A 2/1999 Meyer et al. ..... 307/39
6,158,618 A 12/2000 Mercer ..... 222/25
6,592,008 B2 * 7/2003 Dion ..... 222/135

* cited by examiner

*Primary Examiner*—Gene Mancene
*Assistant Examiner*—Frederick C. Nicolas
(74) *Attorney, Agent, or Firm*—MacCord Mason PLLC

(57) ABSTRACT

A fuel dispensing system. The system includes a plurality of storage tanks for storing a plurality of fuel products; at least one dispenser; at least one pump for pumping fuel from the storage tanks to the dispenser; and a pump controller connected to the dispenser and the pump having a plurality of individual selectors for selecting a specific fuel product. In the preferred embodiment, the pump controller includes a plurality of individual selectors for selecting a specific fuel product; and an interconnecting expandable length bus for connecting additional station components, such as pump control devices, to one another. The system may further include an emergency stop system.

55 Claims, 2 Drawing Sheets

FUEL DISPENSING SYSTEM HAVING A SELECTABLE PUMP CONTROLLER

BACKGROUND OF THE INVENTION (1) Field of the Invention

The present invention relates generally to fuel dispensing systems and, more particularly, to a pump controller having a plurality of individual selectors for selecting a specific fuel product.

(2) Description of the Prior Art

The need to control a number of electrical devices in response to control inputs received from a number of sources, and, in particular, to control relatively few electrical devices in response to control inputs received from relatively many sources, can occur in a variety of control system installations.

In automotive gasoline and diesel-fuel filling stations, for example, several individual fuel hoses or dispensers are typically supplied with fuel provided from a single submersible pump fitted to a common underground storage tank. In larger filling stations, it is not uncommon for as many as eight underground storage tanks to supply fuel to as many as forty-eight hoses. Thus, several control input sources can exist for actuating the submersible pump of each storage tank.

To provide for the selective actuation of individual submersible pumps in response to control inputs received from a number of sources, various systems have been developed. In one such system, individual electrical switches, associated with each of the hoses or dispensers supplied from a common tank, are commonly connected to each other and to the coil of an electrical relay which controls the application of power to a submersible pump fitted to the tank. Although this system is effective in inexpensively implementing the desired control effect, it suffers the serious disadvantage of promoting undesirable "feedbacks" which render all of the unused dispensers electrically "hot" whenever the switch of any one dispenser is closed. In the event it becomes necessary to remove a fuel dispenser from service for purposes of maintenance, repair, or to avoid the creation of a hazardous condition following, for example, an accidental collision between an automobile and a dispenser, the potential for the occurrence of such feedbacks requires that each of the remaining, functioning dispensers, which are connected to the common relay, be shut down also. In a busy station, the need to shut down otherwise fully functional dispensers can have serious adverse economic consequences for the filling station operator.

To avoid the development of such undesirable feedbacks, individual relays, coupled to a common relay for actuating a single submersible pump, can be individually controlled by the switches associated with each hose or dispenser. Although effective, the cost of the relays and additional wiring associated with this approach can be considerable.

Thus, there remains a need for a new and improved fuel dispensing system having a pump controller which provides a plurality of individual selectors for selecting a specific fuel product while, at the same time, includes an interconnecting expandable length bus for connecting additional station control components, such as pump control devices, indicator modules or diagnostic modules, to one another to permit easy expansion for larger stations.

SUMMARY OF THE INVENTION

The present invention is directed to a fuel dispensing system. The system includes: a plurality of storage tanks for storing a plurality of fuel products; at least one dispenser; at least one pump for pumping fuel from the storage tanks to the dispenser; and a pump controller connected to the dispenser and the pump having a plurality of individual selectors for selecting a specific fuel product. In the preferred embodiment, the pump controller includes: a plurality of individual selectors for selecting a specific fuel product; and an interconnecting expandable length bus for connecting additional station components to one another. The system may further include an emergency stop system.

In the preferred embodiment, the storage tanks are underground storage tanks for storing fuel, including gasoline of various grades and diesel fuel. Also, the pumps are submersible pumps located in one or more of the storage tanks. In the preferred embodiment, the system includes at least one pump per product and may further include a plurality of pumps having at least one pump per product.

Each dispenser includes a product nozzle, at least one dispenser pump control signal for activating an associated pump, and a control signal actuator. The control signal actuator is user actuated.

In the preferred embodiment, the pump controller includes a plurality of individual selectors for selecting a specific fuel product; and an interconnecting expandable length bus for connecting additional station components to one another. The plurality of selectors includes bus input selectors and bus output selectors. Each bus input selector is associated with a pair of bus pump control signal lines. In the preferred embodiment, the pairs of bus pump control signal lines are grouped in sets of four for a total of eight bus pump signal lines. Also, each bus output selector is associated with a pump. The interconnecting expandable length bus includes a plurality of bus pump control signal lines and, in the preferred embodiment, the interconnecting expandable bus includes eight bus pump control signal lines.

The pump controller may further include a bus power supply and pump relays. In addition, it also may further include a plurality of electrical isolators, preferably optical isolators, upstream of the plurality of selectors and, preferably, includes at least one isolator per dispenser pump control signal input.

In the preferred embodiment, the interconnecting expandable length bus for connecting additional station components to one another further includes at least one accessory control signal line for lighting or an emergency stop signal line.

The emergency stop system may include at least one emergency stop actuator and at least one electrical power disconnector. In addition, the emergency stop actuator may further include a plurality of emergency stop actuators at various locations. In the preferred embodiment, the electrical power disconnector includes one for each dispenser and one for each pump.

The emergency stop system may further include at least one accessory emergency stop disconnector. In addition, it may further include an emergency system reset. In the preferred embodiment, the emergency stop system reset is normally in an open position. Also, the emergency stop system may include an emergency stop system reset delay module.

Finally, in the preferred embodiment, the emergency stop system includes a microprocessor module. The microprocessor module provides additional functions including: emergency stop and reset switch diagnostics; status and mode indicators; and selectable connections to emergency stop and reset switches.

Accordingly, one aspect of the present invention is to provide a fuel dispensing system including: a plurality of storage tanks for storing a plurality of fuel products; at least one dispenser; at least one pump for pumping fuel from the storage tanks to the dispenser; and a pump controller connected to the dispenser and the pump having a plurality of individual selectors for selecting a specific fuel product.

Another aspect of the present invention is to provide a pump controller for a fuel dispensing system having a plurality of storage tanks for storing a plurality of fuel products; at least one dispenser; at least one pump for pumping fuel from the storage tanks to the dispenser, the pump controller including: (a) a plurality of individual selectors for selecting a specific fuel product; and (b) an interconnecting expandable length bus for connecting additional station components to one another.

Still another aspect of the present invention is to provide a fuel dispensing system including: a plurality of storage tanks for storing a plurality of fuel products; at least one dispenser; at least one pump for pumping fuel from the storage tanks to the dispenser; a pump controller connected to the dispenser and the pump having a plurality of individual selectors for selecting a specific fuel product, the pump controller including: (i) a plurality of individual selectors for selecting a specific fuel product; and (ii) an interconnecting expandable length bus for connecting additional station components to one another; and an emergency stop system.

These and other aspects of the present invention will become apparent to those skilled in the art after a reading of the following description of the preferred embodiment when considered with the drawings.

DESCRIPTION OF THE PREFERRED EMBODIMENTS

Figure 1:
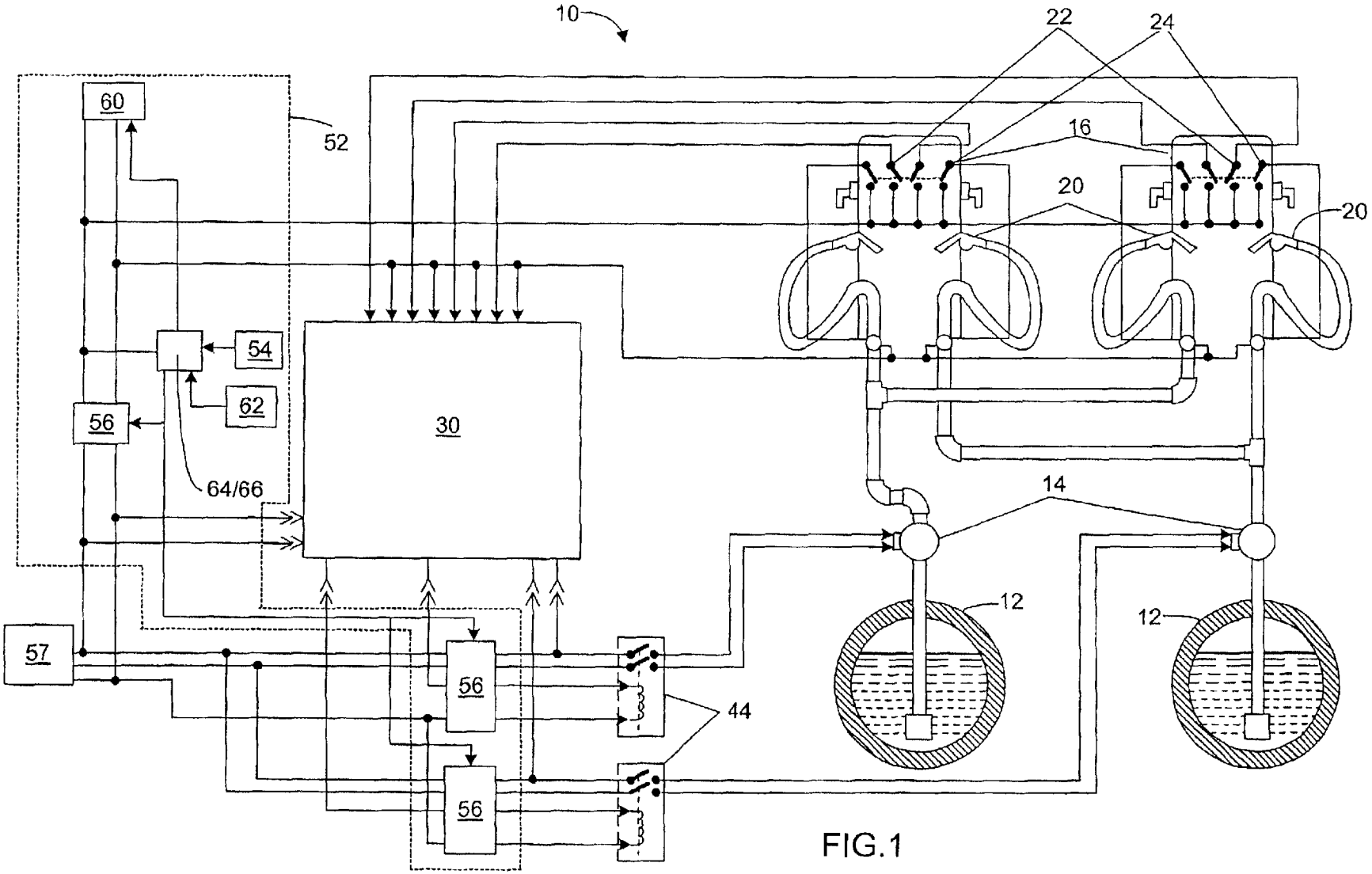
FIG. 1 is schematic representation of a fuel dispensing system constructed according to the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a fuel dispensing system, generally designated 10, is shown constructed according to the present invention. The fuel dispensing system 10 includes of a plurality of storage tanks 12, at least one pump 14, at least one dispenser 16, and a pump controller having a plurality of selectors 30. In the preferred embodiment, the fuel dispensing system 10 further includes an emergency stop system 52.

Typically, the storage tanks 12 are underground storage tanks. The pump 14 may include a plurality of pumps having at least one pump per product. These pumps are preferably submersible pumps.

In the preferred embodiment, the dispenser 16 includes a product nozzle 20, at least one dispenser pump control signal for activating an associated pump 22, and a control signal actuator 24, which can be activated by the user.

Figure 2:
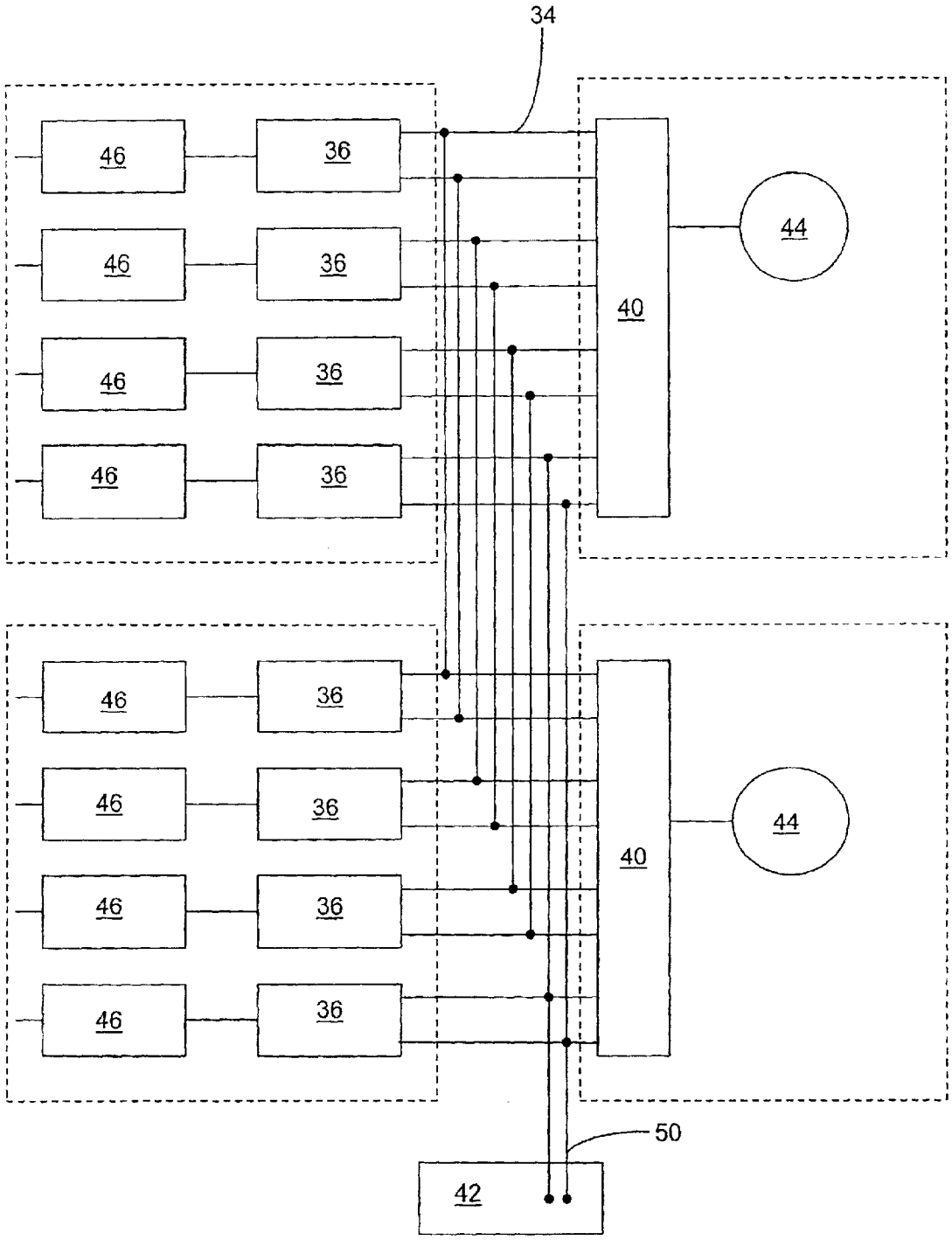
FIG. 2 is a schematic diagram of the circuit layout of a pump controller for the fuel dispensing system shown in FIG. 1.

In the preferred embodiment, the pump controller 30 has a plurality of selectors 36 and 40, as best seen in FIG. 2. In addition, the pump controller 30 also contains an interconnecting expandable length bus 34.

The plurality of selectors 36 and 40 include bus input selectors 36 and bus output selectors 40. In the preferred embodiment, each of the bus input selectors 36 are associated with two pump control signal lines and are grouped in sets of four for eight pump bus control signal lines. The bus output selectors 40 are associated with each individual pump.

The pump controller 30 may include a plurality of isolators 46, which are upstream from the selectors 36 and 40. The isolators 46 are preferably optical isolators and include at least one isolator per dispenser pump control signal input.

In the preferred embodiment, the interconnecting expandable length bus 34 includes eight bus pump control signal lines. The interconnecting expandable length bus 34 may further contain a bus power supply unit 42, at least one accessory control signal line 50, and a pump relay 44.

Referring back to FIG. 1, the emergency stop system 52 may include at least one emergency stop actuator 54 and at least one electrical power disconnector 56. In the preferred embodiment, the emergency stop system 52 may also include at least one accessory emergency stop disconnector output 60 and an emergency stop system reset actuator 62. The emergency stop reset system may further include a reset relay module 64 and/or a microprocessor function module 66.

Dispenser 16 is typically one dispenser cabinet. Each dispenser cabinet has one or two sides to it, but it may only have one set of control wires coming from each cabinet. On a given island there would be 2 or 3 dispenser cabinets depending on the design of the station.

In the preferred embodiment, the selectors are conventional jumper modules. The first A/B (A and B) selectors 36 are used for pump control selection. The second, 8 input selectors 40 are used for pump relay selection. However, a second selector could be built with only 2 inputs. In that case, while each dispenser 16 would still have 4 outputs, when it is a small station, it is not really needed. For example, if it is a site just running blenders, 8 dispenser modules with 4 inputs are not needed when just connecting A, B, or C. The station could just have an A or B regular pumps and an A and a B premium pump and a 2 input pump relay selector would provide enough configurations to do that.

Each of the up to 4 pump control lines of each dispenser which are then broken down to a series of grouped jumpers, grouping 4 inputs per dispenser; each one of those inputs may be varied. Thus, input #1 can be selected between two pumps, input #2 could be selected for two more pumps; input #3 could be selected between two more pumps. Normally, the jumpers 36 are only used to select between one pump and another pump and no single optical isolator 46 is connected to 2 pumps.

For example, referring to FIG. 2 and starting at the optical isolator 46 and going through the first selector with both jumpers in, A and B are the 2 control lines coming out of the dispenser module, and those are 2 of the leads going in to the second selector that has 8 inputs. Those 2 inputs are just 2 of the 8. Therefore, based on that dispenser module, if that pump handle input is to be set to trigger line A, a jumper is put on that junction to trigger line A and then a jumper is put on line A of the pump module.

The present invention allows a single optical isolator to be connected to 2 pump control signal lines. Thus, the present design allows an individual optical isolator to be connected to pump A, pump B, or pump A & B by using jumpers.

The proposed design permits the flexibility that is needed to adapt to a given station setup for a plurality of dispensers, each dispenser having up to 4 dispenser pump control signals. Because each dispenser has up to 4 dispenser pump control signals, the station could have 3 product grades and a diesel that would be the 4th one; and the dispenser could be configured to have access to any 3 of the 4. There are also some situations where the dispenser only uses 3 or less dispenser pump control signals.

There are at least two more scenarios; one is where the station has a dispenser that just has 3 product grades, it has 3 different tanks in the ground for 3 product grades and the dispensers just have 3 dispenser pump control signals, i.e. low grade, mid grade, and high grade. Another scenario is where the station has blenders, 2 pumps are going to turn on in 2 different tanks to provide a mix for the product.

Downstream from the optical isolators 46 and the jumpers 36, before the pump motor relay 44, the output goes through the bus into the second selector 40 to select which pump control line the motor relay is to respond to. The second switch normally has 8 pump control line inputs and selects which of those control lines activates a particular pump relay 44 by a jumper. Normally, only one of those lines will be the one that turns that pump on. However, multiple lines could be used to turn that pump on.

In operation, there is one optical isolator 46 per dispenser pump control signal line and when the user actuates the product nozzle 20, it is only going to activate one pump control line of the input selector or optionally, it could activate as many as 2 by selecting A, B or (A and B). Then, at the other end, as many pump control modules (pump relays) as needed can be selected to respond to a single pump control line. Thus, there could be 2 or more pump relays responding to pump control line #1.

Finally, in some cases, just 2 pump control modules would be used and pump module #1 on the A line and one on the B line and then just make that input control A and B. This is generally used to make sure the station has enough pump pressure because several dispensers are in use at the same time. In addition, there are certain different ways that the jumper could be set based on the way that the station is actually running its piping/doing its pipeline.

For a given pump, when the user pulls that nozzle, normally the station wants 1 and only 1 pump to come on. However, 2 pumps may come on but each relay 44 controls only 1 pump.

The second selector has a maximum of 8 pump control lines. The A/B jumper chooses which pump control that relay is going to respond to. Thus, the station could have dispenser control modules or dispenser cabinets in different locations and it's like a three-way switch in a way in that if the dispenser cabinet nozzle is flipped on, it's going to start that other pump all the way back in another location. For example, the station may have 10 dispenser cabinets and only 2 pumps on the entire site. For example, when the station is only doing low and high grades.

Since each dispenser has up to 4 A/B control line paired inputs, for a blend all the modules are set to use 1A and 2A. As to the pumps, the station would have 1 pump tied to 1A line and 1 pump tied to 2A line, so there would be multiple dispenser modules. The A and B's come in to play when using split systems. For example, there may be 2 separate unleaded systems in the same site and the station is still running blenders. In this case, it only has 2 products going to each dispenser but it actually has 2 separate unleaded systems on the site. Then, the premium grade may be going to all of the dispensers. But, because the station usually sells twice as much of the low-grade, the station may put in 2 pumps in the low grade and split the output to different islands.

Therefore, 2 pumps does not necessarily mean 2 tanks but could just be 2 pumps in the same tank to be sure that there is enough flow capacity to service all the dispensers because the station normally has more customers getting low-grade without even running the premium. That's where product input 1, which has an A and a B to it, has regular-unleaded and then with product input 2, has super-unleaded and then the regular-unleaded half of the dispensers would be jumpered to use A and the other half of the dispenser would be jumpered to use B on product 1, which is the regular-unleaded.

For example, the station may have 2 grades of product and have regular-unleaded which has 2 pumps at the site. It may also have, for example, 8 dispensers. If 4 of the dispensers are going to be using unleaded pump #1, then what the station would do is on those 4 dispenser modules set product 1 input to A. The other 4 dispensers would use the unleaded system or unleaded pump #2 and would set product #1 input to B. The station could then use product input #2 for high-grade but all 8 dispensers could work those by just leaving A on all 8 of them.

While the above scenarios are typical station layouts, there are still other scenarios and control setups that the present invention can address that may or may not exist or ever come up. For instance, one scenario is where the station is using the A and the B and the station also uses a split system, but if for some reason the pump goes down in 1, the station manager wants the other pump to activate. He will then want to mix A and B. In order for if one stops, the other one will still pump, typically, a very difficult piping switch arrangement or a fairly complicated switch arrangement to switch over the controls is used. The station will also need to put a valve in the piping so that it can actually tie the 2 pipe systems together. So, what will happen is, if for any reason the station wants the pumps to respond, then it would tie A and B together so that it will actually disable one of the other pumps. But by having the selectors at both ends, the present invention leaves it open so that a module can be used to perform that function.

The present invention is able to provide this high degree of flexibility out of just being able to go A and B on each of the dispenser modules is because it is actually A and B times 4 since there are 4 inputs to each dispenser module, each input has an A and B output, which that translates to a total of 8 lines, which are the normal 8 control lines. While this could be accomplished with 8 optical isolators, the present invention only requires the use of half the optical isolators.

A matrix switch allows selection all the way across the lines. Any input can go to any output. This is rarely, if ever, needed in practice. The present invention addresses the flexibility a station is likely to need because a lot of times the station will not be using 4 control lines and most of the time just 3 control lines are used. On occasions when the station does have the $4^{th}$ control line in place, it usually is not splitting the dispensing system because stations where the piping is split are typically stations running blenders in the first place.

Particularly in the pump control bus, there are some options of tying those control signals together. Say, if the station wanted pump #1 every time that control comes on, and also to control pump #2, but did not want pump #2 to control pump #1, a module diode can be added to switch that control together in the pump relay.

The second switch could actually be set that to respond to 2 different control lines if needed although it is not known where this would be needed. Also, the output may or may not be connected to use the actual relay. In some cases the switch also has line outputs to control a remote relay for a variable speed controller and then the control signal can be pulled from there. For example, in practice, the second switch turns the pump relay on and then one output goes to the relay and the control voltage to turn on the variable speed controller.

Certain modifications and improvements will occur to those skilled in the art upon a reading of the foregoing description. By way of example, while an A/B switch arrangement is commonly used, an A/B/C/D arrangement could be used in certain situations. It should be understood that all such modifications and improvements have been deleted herein for the sake of conciseness and readability but are properly within the scope of the following claims.

What is claimed is:

1. A fuel dispensing system, said system comprising:

(a) a plurality of storage tanks for storing a plurality of fuel products;

(b) at least one dispenser, (c) at least one pump for pumping fuel from said storage tanks to said dispenser;

(d) a pump controller connected to said dispenser and said pump having a plurality of individual selectors for selecting a specific fuel product; and (e) an emergency stop system that includes an emergency system reset having a reset delay module, at least one emergency stop actuator and at least one electrical power disconnector.

2. The apparatus according to claim 1, wherein said emergency stop actuator further includes a plurality of emergency stop actuators at various locations.

3. The apparatus according to claim 1, wherein said electrical power disconnector includes one for each dispenser and one for each pump.

4. The apparatus according to claim 1, further including at least one accessory emergency stop disconnector.

5. The apparatus according to claim 1, wherein said emergency stop system reset is normally in an open position.

6. The apparatus according to claim 1, further including a microprocessor module, wherein said module provides additional functions including: emergency stop and reset switch diagnostics; status and mode indicators; and selectable connections to emergency stop and reset switches.

7. The apparatus according to claim 1, wherein said storage tanks are underground storage tanks.

8. The apparatus according to claim 1, wherein said pump is a submersible pump.

9. The apparatus according to claim 1, wherein said pump includes at least one pump per product.

10. The apparatus according to claim 1, further including a plurality of pumps having at least one pump per product.

11. The apparatus according to claim 1, wherein said dispenser includes a product nozzle, at least one dispenser pump control signal for activating an associated pump, and a control signal actuator.

12. The apparatus according to claim 1, wherein said emergency stop actuator is user actuated.

13. A pump controller for a fuel dispensing system having a plurality of storage tanks for storing a plurality of fuel products; at least one dispenser; at least one pump for pumping fuel from said storage tanks to said dispenser, said pump controller comprising:

(a) a plurality of individual selectors for selecting a specific fuel product;

(b) an interconnecting expandable length bus for connecting additional station components to one another, said bus including at least one accessory control signal line; and (c) a plurality of electrical isolators upstream of said plurality of selectors.

14. The apparatus according to claim 13, wherein said plurality of selectors includes bus input selectors and bus output selectors.

15. The apparatus according to claim 14, wherein each bus input selector is associated with a pair of bus pump control signal lines.

16. The apparatus according to claim 15, wherein said pair of bus pump control signal lines are grouped in sets of four for a total of eight bus pump signal lines.

17. The apparatus according to claim 14, wherein each bus output selector is associated with a pump.

18. The apparatus according to claim 13, wherein said interconnecting expandable length bus for connecting additional station components to one another includes a plurality of bus pump control signal lines.

19. The apparatus according to claim 18, wherein said interconnecting expandable bus includes eight bus pump control signal lines.

20. The apparatus according to claim 13, further including a bus power supply.

21. The apparatus according to claim 13, further including a pump relay.

22. The apparatus according to claim 13, wherein said electrical isolators are optical isolators.

23. The apparatus according to claim 13, wherein said plurality of electrical isolators upstream of said plurality of selectors includes at least one isolator per dispenser pump control signal input.

24. The apparatus according to claim 13, wherein said at least one accessory control signal line includes a lighting signal line.

25. The apparatus according to claim 13, wherein said at least one accessory control signal line includes an emergency stop signal line.

26. A fuel dispensing system, said system comprising:

(a) a plurality of storage tanks for storing a plurality of fuel products;

(b) at least one dispenser;

(c) at least one pump for pumping fuel from said storage tanks to said dispenser;

(d) a pump controller connected to said dispenser and said pump having a plurality of individual selectors for selecting a specific fuel product, said pump controller including: (i) a plurality of individual selectors for selecting a specific fuel product; and (ii) an interconnecting expandable length bus for connecting additional station components to one another; and (e) an emergency stop system that includes an emergency system reset having a reset delay module, at least one emergency stop actuator and at least one electrical power disconnector.

27. The apparatus according to claim 26, wherein said emergency stop actuator further includes a plurality of emergency stop actuators at various locations.

28. The apparatus according to claim 26, wherein said electrical power disconnector includes one for each dispenser and one for each pump.

29. The apparatus according to claim 26, further including at least one accessory emergency stop disconnector.

30. The apparatus according to claim 26, wherein said emergency stop system reset is normally in an open position.

31. The apparatus according to claim 26, further including a microprocessor module, wherein said module provides additional functions including: emergency stop and reset switch diagnostics; status and mode indicators; and selectable connections to emergency stop and reset switches.

32. The apparatus according to claim 26, wherein said storage tanks are underground storage tanks.

33. The apparatus according to claim 26, wherein said pump is a submersible pump.

34. The apparatus according to claim 26, wherein said pump includes at least one pump per product.

35. The apparatus according to claim 26, further including a plurality of pumps having at least one pump per product.

36. The apparatus according to claim 26, wherein said dispenser includes a product nozzle, at least one dispenser pump control signal for activating an associated pump, and a control signal actuator.

37. The apparatus according to claim 26, wherein said emergency stop actuator is user actuated.

38. The apparatus according to claim 26, wherein said plurality of selectors includes bus input selectors and bus output selectors.

39. The apparatus according to claim 38, wherein each bus input selector is associated with a pair of bus pump control signal lines.

40. The apparatus according to claim 39, wherein said pair of bus pump control signal lines are grouped in sets of four for a total of eight bus pump signal lines.

41. The apparatus according to claim 38, wherein each bus output selector is associated with a pump.

42. The apparatus according to claim 26, wherein said interconnecting expandable length bus for connecting additional station components to one another includes a plurality of bus pump control signal lines.

43. The apparatus according to claim 42, wherein said interconnecting expandable bus includes eight bus pump control signal lines.

44. The apparatus according to claim 26, further including a bus power supply.

45. The apparatus according to claim 26, further including a pump relay.

46. The apparatus according to claim 26, further including a plurality of electrical isolators upstream of said plurality of selectors.

47. The apparatus according to claim 46, wherein said electrical isolators are optical isolators.

48. The apparatus according to claim 46, wherein said plurality of electrical isolators upstream of said plurality of selectors includes at least one isolator per dispenser pump control signal input.

49. The apparatus according to claim 26, wherein said interconnecting expandable length bus for connecting additional station components to one another further includes at least one accessory control signal line.

50. The apparatus according to claim 49, wherein said at least one accessory control signal line includes a lighting signal line.

51. The apparatus according to claim 49, wherein said at least one accessory control signal line includes an emergency stop signal line.

52. A fuel dispensing system, said system comprising:

(a) a plurality of storage tanks for storing a plurality of fuel products;

(b) at least one dispenser;

(c) at least one pump for pumping fuel from said storage tanks to said dispenser;

(d) a pump controller connected to said dispenser and said pump having a plurality of individual selectors for selecting a specific fuel product; and (e) an emergency stop system comprising:

(i) at least one emergency stop actuator;

(ii) a microprocessor module having inputs and outputs, at least one of said inputs being interfaced with said emergency stop actuator; and (iii) at least one electrical power disconnector in communication with at least one of said microprocessor module outputs, wherein said microprocessor module is programmable to command said at least one electrical power disconnector to disconnect power from said at least one dispenser upon activation of said emergency actuator.

53. The apparatus according to claim 52, further including at least one status indicator in communication with said microprocessor module, said status indicator being responsive to said at least one emergency stop output.

54. The apparatus according to claim 52, further including at least one emergency stop system reset switch in communication with at least one of said microprocessor module inputs.

55. The apparatus according to claim 52, wherein said microprocessor module is programmable to function in part as a delay reset module.

* * * * *